United States Patent [19]

Sloane

[11] Patent Number: 4,860,627

[45] Date of Patent: Aug. 29, 1989

[54] TUNING MACHINES

[76] Inventor: Irving Sloane, McGhee Hill Rd., Millerton, N.Y. 12546

[21] Appl. No.: 177,535

[22] Filed: Apr. 4, 1988

[30] Foreign Application Priority Data

Apr. 2, 1987 [GB] United Kingdom ..... 8707870

[51] Int. Cl.[4] ..... G10D 3/14

[52] U.S. Cl. ..... 84/306

[58] Field of Search ..... 84/304–306

[56] References Cited

U.S. PATENT DOCUMENTS

| | | | |
|---|---|---|---|
| 1,083,736 | 6/1914 | Glaesel | 84/306 |
| 2,615,360 | 10/1952 | Hawy | 84/306 X |
| 3,982,462 | 9/1976 | Schaller | 84/306 |
| 4,098,163 | 7/1978 | Kato | 84/306 |
| 4,515,059 | 5/1985 | Siminoff | 84/306 |

FOREIGN PATENT DOCUMENTS

| | | | |
|---|---|---|---|
| 608558 | 9/1948 | United Kingdom | 84/306 |
| 611849 | 11/1948 | United Kingdom . | |

*Primary Examiner*—Lawrence R. Franklin

*Attorney, Agent, or Firm*—Lowe, Price, LeBlanc, Becker & Shur

[57] ABSTRACT

A machine for tuning a guitar comprises a pair of facing posts extending at right angles to a wall of a base to be mounted on the guitar; the posts and wall being an integral casting of silicon bronze. A worm gear assembly is mounted in bores with a common axis in the posts. The worm gear assembly includes a worm gear shaft extending between the bores and a handle carrying shaft protruding beyond one of said posts. A gear wheel assembly secured to an extending through a bore in the wall has a gear wheel portion with a longitudinal axis at right angles to the worm gear shaft axis. The gear wheel portion engages the worm gear shaft axis so that turning of the handle and the worm gear results in turning of the gear sheet portion. The gear wheel assembly includes a guitar string tuning peg coaxial with the gear wheel assembly. Because a side of the wall is smooth, without bumps, the machine can be mounted in a wooden guitar head without making corresponding holes in the wood except for through holes for receiving the gear wheel assembly. A bore in one of the posts is threaded to receive the worm gear assembly. A metal washer is between the collar and the post having the threaded bore. A nylon washer is between a shoulder on the base wall and the tuning peg assembly side.

1 Claim, 2 Drawing Sheets

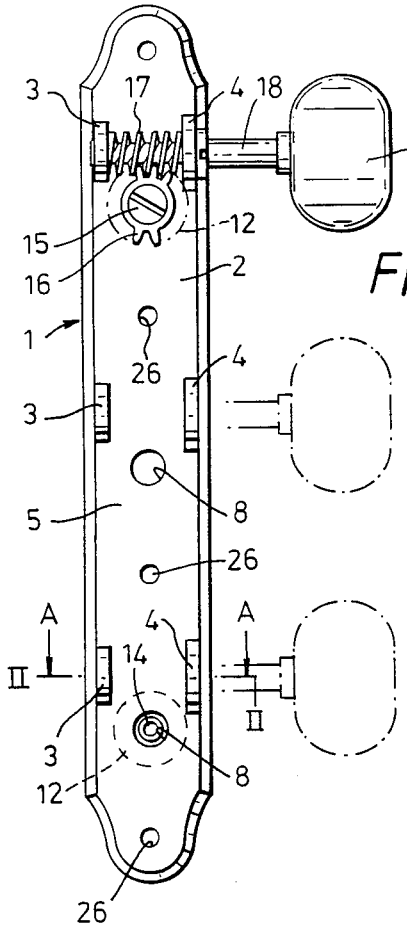
Fig.1.
Fig.2.
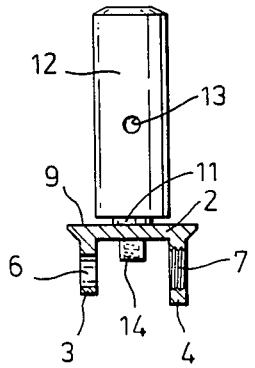
Fig.3.
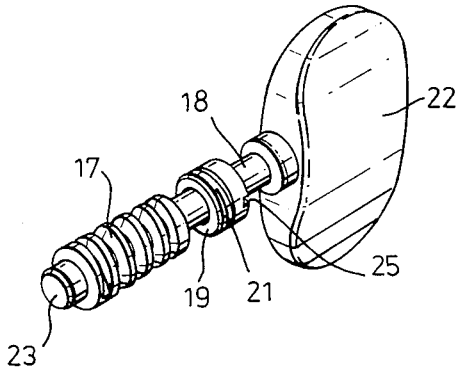
Fig.4.
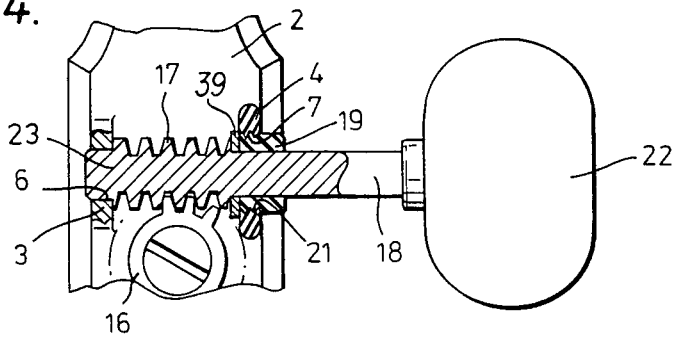

TUNING MACHINES

FIELD OF INVENTION

The present invention relates generally to tuning machines for stringed musical instruments, particularly for guitars, and to a method of making such tuning machines, and more particularly to a tuning machine having a base including a wall and worm gear carrying posts cast as an integral unit.

BACKGROUND ART

In tuning machines for guitar strings, a string is tensioned by winding one end of the string on a tuning peg fixed to a gear wheel. The gear wheel is driven by a hand-turned worm gear.

In known arrangements, the worm gear is supported by a pair of stamped posts extending from one face of a base plate. Each post has a bore for supporting a shaft of the worm gear. During assembly, a tab extending from the post enters a hole in the base plate to enable the post to be fixed to the base plate by peening over the end of the tab on the side of the base plate opposite from the post. The posts are arranged on the base plate in pairs so a worm gear extending into the bore in each post is supported between a pair of posts.

The worm gear is held in place by a collar placed over one end of a worm gear shaft. The worm gear shaft is on the outer face of a post at a location where the shaft extends through the post. The end of the worm gear shaft is then peened over the collar.

The normal technique for assembling the prior art machine begins by slipping a post over each end of a worm gear and inserting the tabs into a respective hole in the base plate. The machine is then turned over so the posts are pressed against the ends of the worm gear while the tabs are peened over with a hammer or small punch press. The worm gear is then locked in place by slipping a collar over the protruding end of the worm gear shaft and by peening the end of the shaft over the collar.

The peening operations are not conducive to producing a tuning machine that is very true or rigid. Peening the ends of the tabs over tends to deform the bores in the posts, making them more oval than round. Furthermore, the bores which are formed during a stamping operation are not truly round initially. The out of round bores do not properly support the worm gear so that the worm position tends to be sloppy.

The worm gear shaft looseness and effects of end play thereof cause a gear wheel, which is fixed to the spool, to mesh eccentrically with a manually driven worm gear as a result of shifting between them.

An object of the present invention is to provide a new and improved stringed instrument tuning machine having great stability in the position of moving parts and to a method of forming same.

Another object of the invention is to provide a new and improved stringed instrument tuning machine having bores that are drilled and reamed with very high accuracy at predetermined locations in a body of the machine.

A further object of the invention is to provide a guitar string tuning machine that lies flat against wood of the guitar head without forming holes in the head to accept rivets of a base of the tuning machine.

An additional object of the invention is to provide a stringed instrument tuning machine having a button-worm gear assembly that is easily replaced if, for example, it is damaged.

Yet another object of the invention is to provide a stringed instrument tuning machine wherein rotational friction between a manually turned bottom-worm gear assembly and a string winding gear wheel assembly is easily regulated.

Still a further object of the invention is to provide a stringed instrument tuning machine that is easily fabricated enabling a base plate or wall thereof to have a carved, relief design of a type that can not be achieved with prior art stamping methods for forming baseplates.

Yet an additional object of the invention is to provide a stringed instrument tuning machine having increased corrosion resistance.

Still another object of the invention is to provide a stringed instrument tuning machine having a high degree of rotational smoothness between a manually turned button-worm gear assembly and a string winding gear wheel assembly because there is virtually no backlash between the assemblies.

The Invention

In accordance with the present invention, a machine for tuning a stringed instrument comprises a base adapted to be mounted on the instrument, the base including a pair of facing posts extending at right angles to a wall of the base wherein the posts and wall are formed as an integral casting. The posts have bores with a common axis. A worm gear assembly mounted in the bores includes a worm gear shaft extending between the bores and a shaft protruding beyond one of the posts away from the other post. A gear wheel assembly secured to and extending through a bore in the wall has a gear wheel portion with a longitudinal axis at right angles to the worm gear shaft axis. The gear wheel portion engages the worm gear, so that turning of a handle on the worm gear results in turning of the gear wheel portion. The gear wheel assembly includes a string receiving peg, that extends away from a first side of the wall opposite from the second side of the wall from which the gear wheel portion extends. The string is wound on the tuning peg by turning the peg in response to manual turning of the gear wheel portion.

Preferably the first side of the wall is smooth, without bumps, so that the machine can be mounted in the wood of a guitar head without making corresponding holes in the wood except for through holes for receiving the gear wheel assembly.

The bore in one of the posts is threaded to receive a threaded collar of the worm gear assembly.

The tuning peg portion has an end with a drilled and tapped bore. A screw in the drilled and tapped bore holds the gear wheel assembly in place on the base. The end of the tuning peg assembly has a shoulder that abuts against the first side of the base wall and fits snugly in the bore of the base.

The base is investment casted of silicon bronze. which resists corrosion and permits carved relief designs therein.

The above and still further objects, features and advantages of the present invention will become apparent upon consideration of the following detailed description of a specific embodiment thereof, especially when taken in conjunction with the accompanying drawings.

BRIEF DESCRIPTION OF THE DRAWINGS

FIG. 1 is a plan view of a partly assembled stringed instrument tuning machine in accord with a preferred embodiment of the invention;

FIG. 2 is a vertical cross-section view through the line II—II (FIG. 1) in the direction of the arrows A;

FIG. 3 is a perspective view of a worm gear and button of the machine illustrated in FIG. 1;

FIG. 4 is an enlarged horizontal cross-section view through the worm gear of FIG. 1.

DESCRIPTION OF PREFERRED EMBODIMENT

Figure 5:
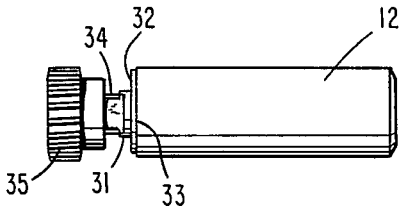
FIG. 5 is a side view of a worm gear and turning tuning peg assembly when not mounted on the plate illustrated in FIGS. 1 and 2.

Tuning machine 1 for strings of a guitar having a wooden head includes base 2 and three pairs of facing posts 3 and 4 which extend at right angles from upper surface 5 of a wall of base 2. Base 2 is a unitary cast member so that the wall and posts 3 and 4 are a unitary structure made of the same material. Posts 4 extend away from surface 5 by a greater distance than posts 3. In each of the posts 3, there is an unthreaded bore 6 and in each of the posts 4, there is a threaded bore 7. Bores 6 and 7 in each pair of posts have a common axis parallel to surface 5 but bore 6 has a smaller diameter than bore 7.

Figure 6:
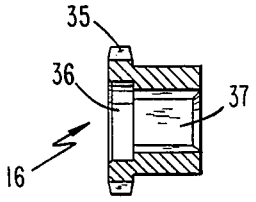
FIG. 6 is a side sectional view of the gear wheel illustrated in FIG. 5.
Figure 7:
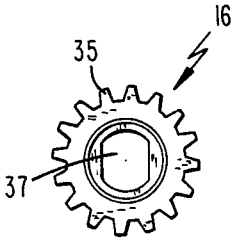
FIG. 7 is a sectional view taken through the line 7—7, FIG. 6.
Figure 8:
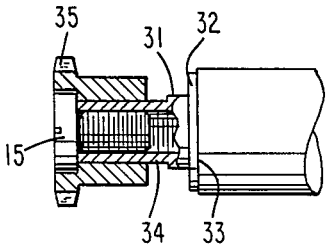
FIG. 8 is a partial sectional view of the assembly illustrated in FIG. 5.

Bores 8 in base 2 extend between upper surface 5 and lower flat surface 9, i.e., the surface of the tuning machine which abuts against wooden guitar head so that the axes of bores 8 are at right angles to the axes of bores 6 and 7. Each of three gear wheel assemblies (only one shown) includes cylindrical tuning peg 12 having hole 13 for carrying a guitar string (FIGS. 2 and 5). Each of the gear wheel assemblies comprises stub shaft 11 that passes through and is snug with bore 8. Shaft 11 includes cylindrical section 31 that projects from tuning peg 12 and on which is fitted nylon washer 32 having opposite faces that respectively abut against flat lower face 9 of base 2 and flat end 33 of tuning peg 12. Section 31 fits snugly in bore 8 and the entire gear wheel assembly is firmly mounted on base 2. To these ends, extending from section 31 is shaft section 34 having a double D cross section, i.e., two diametrically opposite arcuate peripheral segments of a common circle connected together by a pair of parallel lines. The arcuate segments of shaft section 34 are on the periphery of a circle having a diameter slightly less than the diameter of the circle for shaft section 31. Fixedly mounted on shaft section 31 is gear wheel 16, FIGS. 6 and 7, having gear portion 35, and cylindrical bore 36 that is counter-bored with double D opening 37. Shaft section 34 fits snugly into double D opening 37 which is held in place by screw 15 having threads that engage threads in bore 41 of shaft section 34. String tension is adjusted by turning each of the gear wheel assemblies about the common longitudinal axis of peg 12 and shaft 11. In response to peg 12 being turned about its longitudinal axis, the string tension is varied as the string is wound or unwound on the tuning peg.

Gear wheel 16 is rotatably driven about its longitudinal axis by worm gear 17 carried by shaft 18. Shaft 18 carries collar 19, having threaded outer surface 21 located on shaft 18 between the gear 17 and button 22 to engage the threads of bore 7. Shaft 18 carries thin brass washer 39 having opposite faces that abut against opposed end faces of collar 19 and 17 when the worm gear assembly is fitted on base 2. Shaft 18 is manually rotated by turning button 22, in a wellknown manner.

Shaft 18 carrying worm gear 17 is assembled with the remainder of machine 1 by passing worm gear 17 and shaft 18 through bore 7 in post 4 until end 23 of shaft 18 enters the bore in post 3 and worm gear 17 meshes with gear wheel 16.

The assembly including shaft 18, collar 19 and button 22 is retained in position by screwing thread 21, on the outside of collar 19, into threaded bore 7 in post 4, as best seen in FIG. 4.

Collar 19 includes slot 25 for enabling the collar to be screwed into position with the aid of an appropriate tool. Holes 26 in base 2 enable the base to be attached to a guitar.

Base 2 and posts 3 and 4 are cast in a single piece of the same material, thereby providing repeated, consistent accurate relative positioning of hole pairs 6 and 7. Because tuning machine 1 is cast, there is a rigid relationship between base 2 and post pairs 3, 4 without the need for further assembly steps.

Base 2 and post pairs 3, 4 are cast using the investment or lost wax casting process. The master or core is made in silicon bronze and copied in wax, upon which the investment is made, thereby enabling the wax to be melted out and to be replaced by a casting in silicon bronze. This process makes it possible to reproduce an intricate decorative pattern on surface 5 of base 2 and enables a post and base assembly to be produced in one operation with accurately positioned parts.

Bores 6 and 7 in posts 3 and 4 are cast slightly undersize and are enlarged to size with reamers. Bores 7 are threaded and slightly counterbored to receive threaded bush or collar 19 which locks worm gear 17 in place. The thread on collar 19 is such that the back pressure of worm gear 17 is insufficient to cause collar 19 to become undone. Collar 19 is screwed into threadbore 7 until the collar bears against the shoulder of worm gear 17 with just the right amount of pressure. With the nub end of worm gear shaft 18 lodged in bore 6, shaft 18 is supported with slide-fit precision in collar 19 so there is no chance of end play or looseness; this prevents a reduction in turning efficiency. In the preferred embodiment, gear wheel 16 is made of a silicon bronze alloy and the assembly including wheel 16 and worm gear 17 has a 16:1 gear ratio.

The combination of nylon washer 32 and brass washer 39 has been found experimentally to appreciably improve the performance of the device. Nylon washer 32 stabilizes the position of peg 12 and helps to reduce any unevenness in the vicinity of bore 8 through which shaft section 31 passes because the nylon washer has some give across the thickness thereof. Bronze washer 39 absolutely prevents bushing or collar 19 from becoming unscrewed from the threads in bore 7 of post 4.

It is, of course, possible to produce left or right hand machines with equal ease and quality.

The arrangement described has the advantage that the silicon bronze alloy employed is harder and has greater corrosion resistance than the more usual brass. Underside 9 of base 2 is smooth in the embodiment described. In contrast, in the prior art tuning machine having peened-over tabs, bumps on the underside require corresponding hollows to be made in the wooden portion of the guitar head. Otherwise, the prior art tuning machine does not lie flat against the head. A further advantage of the arrangement described is that the worm gear and button assembly can be easily replaced if damaged. In prior art machines having peened-over or riveted parts, the complete machine must be discarded if the worm gear and button assembly needs replacement.

It will be appreciated that although the invention has been described with reference to a particular embodiment, variations and modifications may be made within the scope of the invention. For example, other means than a screwed bush may be employed to lock worm gear 17 in place in a way that enables it to be replaced comparatively easily.

What is claimed:

1. A machine for tuning a guitar having a wooden head comprising a base adapted to be mounted on the head, the base including first, second and third pairs of facing posts extending at right angles to a wall of the base, the first pair being on the center of the base, the second and third pairs being oppositely disposed on the base relative to the first pair of posts, the posts and wall being formed as an integral investment casting, the post of each of said pairs having bores with a common axis; first, second and third worm gear assemblies mounted in said base in said bores of said first, second and third pairs of posts, respectively, each of the worm gear assemblies including a worm gear shaft extending between the respective bores and a shaft protruding one of said posts of the respective pair of posts away from the other post of the pair of posts, the protruding and worm gear shafts associated with each of said pairs being aligned; a handle on each of the protruding shafts; first, second and third gear wheel assemblies secured to and extending through first, second and third bores in the wall in close proximity to the bores associated with the first, second and third pairs, each of said first, second and third gear wheel assemblies having a gear wheel portion with a longitudinal axis at right angles to the worm gear shaft of the first, second and third worm gear assemblies, respectively, the first, second and third gear wheel portions respectively engaging the first, second and third worm gear shafts so that turning of the handles and the worm gears of the first, second and third worm gear assemblies results in the turning of the gear wheel portions of the first, second and third gear wheel assemblies respectively; the first, second and third gear wheel assemblies including first, second and third tuning pegs coaxial with the respective gear wheels, each of the tuning pegs extending away from a first side of the wall opposite from a second side of the wall from which each of the gear wheel portions extends, each of the tuning pegs being adapted to receive the string so that as each of the tuning pegs is turned in response to turning of the respective gear wheel portion, the respective string is wound on the respective tuning peg; the first side of the wall being smooth, without bumps, so that the machine can be mounted on the wooden guitar head without making corresponding holes in the wooden head, except through holes for receiving the gear wheel assembly; the bore in the post closest to the handle of each of the first, second and third pairs of facing posts being threaded; each of the first, second and third gear wheel assemblies including a threaded collar threaded into the threads of the threaded bores of said first, second and third pairs of facing posts, respectively; first, second and third metal washers respectively positioned between the collars and an end face on the worm gear shaft of each of the first, second and third worm gear assemblies, respectively; each of the tuning pegs having an end with a drilled and tapped bore, a screw in each of the drilled and tapped bores holding the respective tuning peg in place on the base; said ends of each of said first, second and third tuning pegs having a shoulder effectively abutting against the first side of the base wall and fitting snugly in the first, second and third bores of the base, respectively; a nylon washer between each of the shoulders and the first side of the base wall; and a structure on each of the collars for receiving a tool for rotating the collar to screw it into position.

* * * * *